US009027931B2

(12) United States Patent
Tomura

(10) Patent No.: US 9,027,931 B2
(45) Date of Patent: May 12, 2015

(54) SEAL MECHANISM

(75) Inventor: Masayuki Tomura, Kanagawa (JP)

(73) Assignee: Piolax, Inc., Yokohama-Shi, Kanagawa (JP)

( * ) Notice: Subject to any disclaimer, the term of this patent is extended or adjusted under 35 U.S.C. 154(b) by 329 days.

(21) Appl. No.: 13/312,845

(22) Filed: Dec. 6, 2011

(65) Prior Publication Data

US 2012/0139185 A1 Jun. 7, 2012

(30) Foreign Application Priority Data

Dec. 7, 2010 (JP) ..... 2010-272616

(51) Int. Cl.
*F01L 1/344* (2006.01)

(52) U.S. Cl.
CPC ..... *F01L 1/3442* (2013.01); *F01L 2001/34479* (2013.01)

(58) Field of Classification Search
CPC ... F16J 15/0818; F16J 15/0825; F16J 15/061; F16J 15/0831; F01L 2001/34479
USPC ..... 129/90.15, 90.17, 90.31, 90.37; 74/568 R; 464/1, 2, 160; 277/590, 591, 277/598
See application file for complete search history.

(56) References Cited

U.S. PATENT DOCUMENTS 4,338,992 A 7/1982 Handa
5,957,098 A * 9/1999 Fukuhara et al. ..... 123/90.17
6,516,762 B1 * 2/2003 Kinugawa et al. ..... 123/90.17
2002/0069844 A1 6/2002 Kinugawa et al.
2002/0139334 A1 10/2002 Kinugawa

FOREIGN PATENT DOCUMENTS

CN 101463738 A 6/2009
CN 201269117 Y 7/2009
JP S55-131693 A 10/1980
JP H10-331613 A 12/1998
JP 2001-193421 A 7/2001
JP 2001-241413 A 9/2001
JP 2002-180806 A 6/2002
JP 2005-083264 A 3/2005
JP 2012-047304 A 3/2012
JP 2012-122521 A 6/2012

OTHER PUBLICATIONS

Japanese Notification of Reasons for Refusal dated Dec. 17, 2013 with English translation.
International Search Report in corresponding PCT Application No. PCT/JP2012/002806 dated Aug. 7, 2012.
Chinese Office Action dated Jan. 20, 2015 with English Translation.

* cited by examiner

*Primary Examiner* — Gilbert Lee
(74) *Attorney, Agent, or Firm* — McGinn IP Law Group, PLLC

(57) ABSTRACT

According to an aspect of the present invention, there is provided a seal mechanism, including: a plate spring having a main body portion which has a curved shape and a pair of hook portions which are formed by bending the main body portion; and a seal member having a seal surface and a pair of projecting portions which are formed on an opposite side of the seal surface to catch the hook portions.

17 Claims, 4 Drawing Sheets

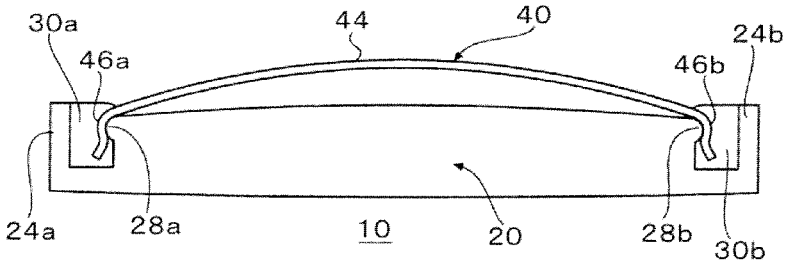
FIG. 6A
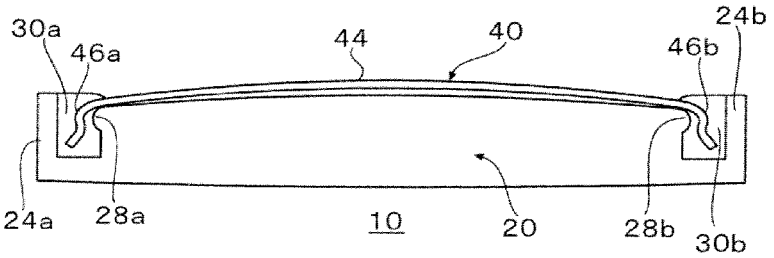
FIG. 6B
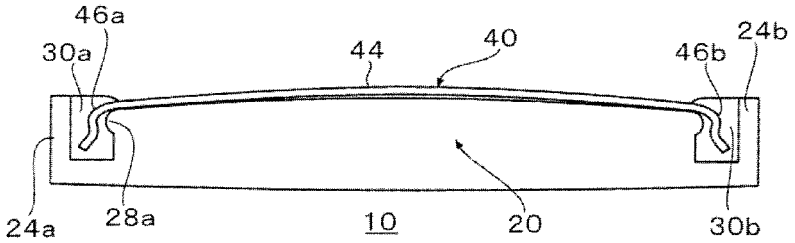
FIG. 6C
FIG. 7
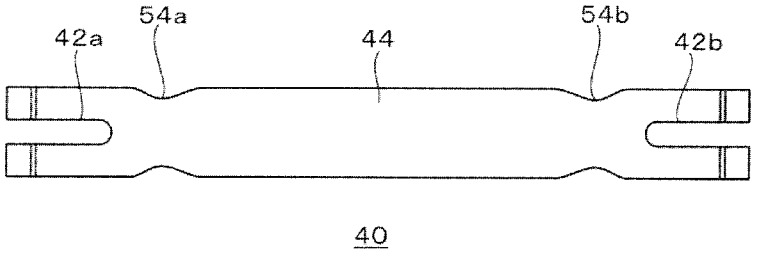

SEAL MECHANISM

CROSS-REFERENCE TO RELATED APPLICATION(S)

This application claims priorities from Japanese Patent Application No. 2010-272616 filed on Dec. 7, 2010, the entire contents of which are incorporated herein by reference.

FIELD

The present invention relates to a seal mechanism for urging a seal member having a seal surface by a plate spring.

BACKGROUND

For example, a valve timing adjusting system is provided for an engine of a motor vehicle. An engine has induction/exhaust valves. For example, such valve timing adjusting system is provided between a crankshaft of the engine and a camshaft linked with the induction/exhaust valves, to thereby adjust opening/closing timing of the induction/exhaust valves according to an operation condition of the engine, by changing the relative rotational position of the camshaft to the crankshaft.

The valve timing adjusting system includes a vane which rotates with the camshaft and a cylindrical housing which rotates with the crankshaft. The vane is accommodated within the housing. And, the vane and the housing are designed to rotate relatively within a certain rotational angle range.

The vane has plural outwardly projecting portions, whereas the housing has plural inwardly projecting portions. And, plural hydraulic chambers are formed between an outer circumferential surface of the vane and an inner circumferential surface of the housing, so as to be partitioned alternately by the outwardly projecting portions and the inwardly projecting portions. When a hydraulic pressure is supplied to the hydraulic chambers, the vane and the housing rotate relatively.

The relative rotational positions of the vane and the housing are controlled by controlling the hydraulic pressure supplied to the hydraulic chambers. By changing the relative rotational phase of the camshaft to the crankshaft, the valve timing is adjusted.

In the above-mentioned valve timing adjusting system, in order to prevent oil leakage from the hydraulic chambers, for example, depressions are formed in the outwardly projecting portions of the vane and the inwardly projecting portions of the housing, and a seal mechanism is provided in each of the depressions. Thus, the seal mechanisms in the outwardly projecting portions of the vane are brought into sliding contact with the inner circumferential surface of the housing, whereas the seal mechanisms in the inwardly projecting portions of the housing are brought into sliding contact with the outer circumferential surface of the vane.

JP-2002-180806-A discloses a seal device to be used in a valve timing adjusting system. The seal device includes a seal member and a plate spring mounted on the seal member. In the seal member, projecting guides provided at both ends thereof are deformed into stopper portions by ultrasonic machining. Thus, the plate spring is mounted on the seal member in a state where both ends of the plate member are held between the stopper portions and a rear surface (opposite to a sealing surface) of the seal member. The plate spring has an arc-shaped central portion and leg portions which are formed parallel to each other at both ends of the central portions.

In JP-2002-180806-A, the stopper portions are formed by ultrasonic machining, and therefore, additional works are necessary to mount the plate spring on the seal member. In addition, when ultrasonic machining is applied to a resin material, a large shape variation may be caused among the stopper portions. The leg portions at both the ends of the plate spring may be warped up when the central portion of the plate spring is pressed, such that the ends of the plate spring contact the stopper portions. Here, since the large shape variation is caused among the stopper portions as mentioned above, a variation in timing of contact between the ends of the plate spring and the stopper portions is also caused. Thus, the spring properties of the plate spring may vary.

SUMMARY

One object thereof is to provide a seal mechanism which can facilitate the mounting of a plate spring on a seal member and stabilize the spring properties of the plate spring.

According to an aspect of the present invention, there is provided a seal mechanism, including: a plate spring having a main body portion which has a curved shape and a pair of hook portions which are formed by bending the main body portion; and a seal member having a seal surface and a pair of projecting portions which are formed on an opposite side of the seal surface to catch the hook portions.

The hook portions may be each formed into an arc-like shape. Surfaces of the projecting portions may be each formed into an arc-like shape so as to match the arc-like shape of the hook portion.

Both ends of the plate spring may be free ends.

The seal member may have an erected portion which is erected on the opposite side of the seal surface. The projecting portions may project from end faces of the erected portion.

Bent back portions may be formed at the ends of the plate spring so as to be bent back from the hook portions.

The plate spring may have slit portions formed to bifurcate the ends thereof. The seal member may have wall portions which are formed on the opposite side of the seal surface at both ends thereof and a pair of protruding portions which protrude from the wall portions so that the slit portions are fitted thereto, respectively. The protruding portions may protrude further in a direction perpendicular to the seal surface than the projecting portions.

According to the above configurations, the plate spring can easily be mounted on the seal member by hooking the hook portions of the plate spring on the projecting portions of the seal member. Since the plate spring is not secured to the seal member but is merely hooked on the seal member, even when a force is imparted to the plate spring, the projecting portions do not interrupt the movement of the plate spring, thereby stabilizing the spring properties of the plate spring in the seal mechanism.

According to the present invention, the plate spring can easily be mounted on the seal member, and the spring properties of the plate spring can be stabilized.

BRIEF DESCRIPTION OF DRAWINGS

FIGS. 6A to 6C illustrate the function of the seal mechanism.

FIG. 7 illustrates a modified example of a plate spring according to the embodiment, as viewed from above.

DETAILED DESCRIPTION

Figure 1A:
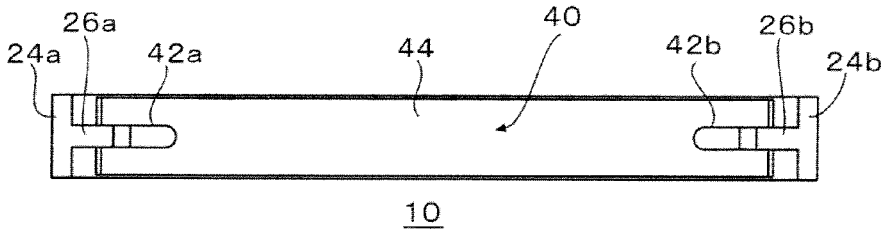
FIGS. 1A to 1C illustrate a seal mechanism according to an embodiment.
Figure 1B:
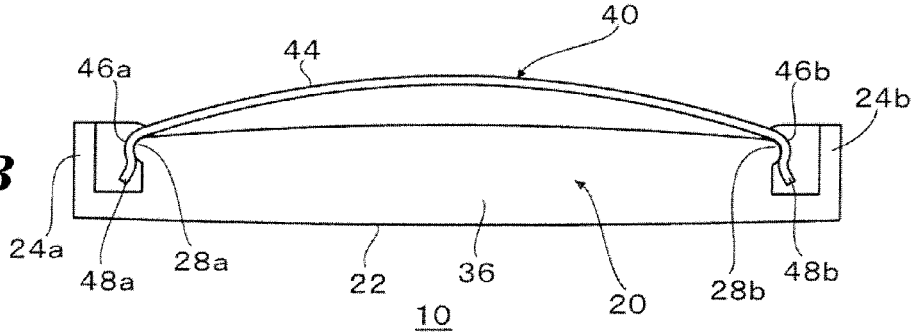
Figure 1C:
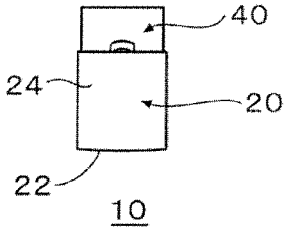

FIGS. 1A to 1C illustrate a seal mechanism 10 according to an embodiment. FIG. 1A illustrates a top plan view of the seal mechanism 10, FIG. 1B illustrates a side view of the seal mechanism 10, and FIG. 1C illustrates an end view of the seal mechanism 10. Like reference numerals will be given to the same or like constituent elements and members which are illustrated in the following drawings.

For example, the seal mechanism 10 is provided in a valve timing adjusting system which adjusts timing for opening/closing an induction valve or an exhaust valve of an internal combustion engine. The valve timing adjusting system has a hydraulic chamber which is partitioned between a vane and a housing, and the seal mechanism 10 is provided to suppress the leakage of hydraulic pressure from the hydraulic chamber. For example, such hydraulic chamber is provided in plurality along a circumferential direction, and two seal mechanisms 10 are provided for each of the hydraulic chambers.

The seal mechanism 10 includes a plate spring 40 and a seal member 20. The plate spring 40 urges the seal member 20 so that the seal surface 22 contacts a wall surface of the housing.

Figure 2:
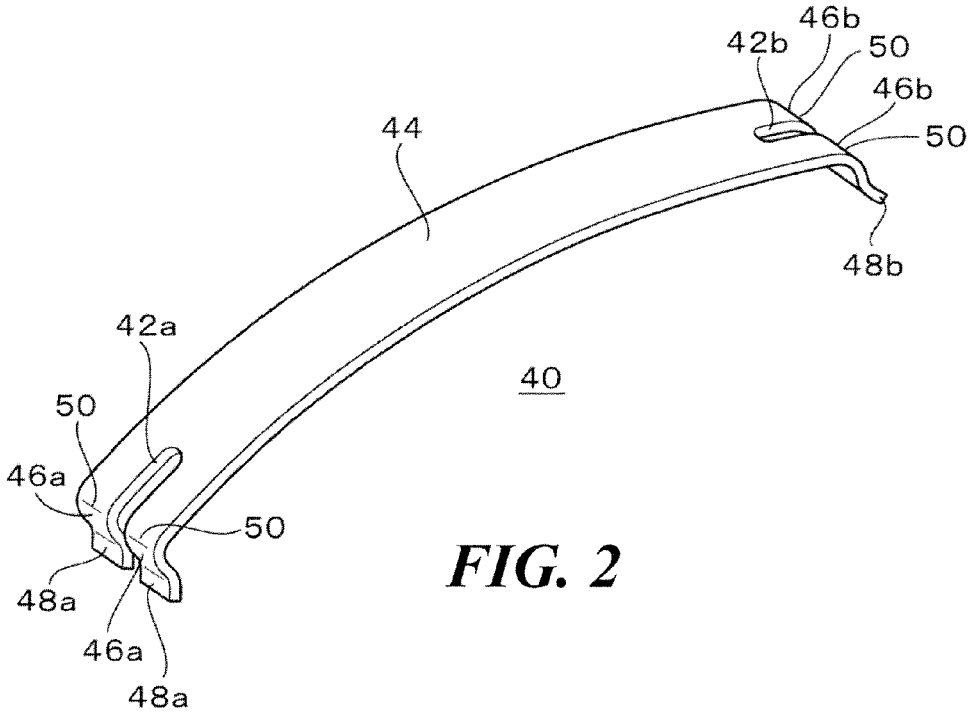
FIG. 2 illustrates a plate spring according to the embodiment.

FIG. 2 illustrates the plate spring 40 according to the embodiment. The plate spring 40 is formed of a metal material and has a main body portion 44 having a curved shape, a first hook portion 46*a* and a second hook portion 46*b* (they may be collectively referred to as "hook portions 46") and a first bent back portion 48*a* and a second bent back portion 48*b* (they may be collectively referred to as "bent back portions 48"). The first hook portion 46*a* and the second hook portion 46*b* are formed by bending the plate spring 40. The first bent back portion 48*a* and the second bent back portion 48*b* are bent back from the first hook portion 46*a* and the second hook portion 46*b*, respectively Slit portions 42 are formed from both ends of the plate spring 40 along a longitudinal direction thereof, so as to bifurcate the hook portions 46, the bent back portions 48 and parts of the main body portion 44.

Bending portions 50 are provided on the main body portion 44 by further bending ends of the main body portion 44. In this embodiment, the bending portions 50 function as the hook portions 46. And, the main body portion 44 is defined as a curved portion between the bending portions 50. Connecting portions between the hook portions 46 and the bent back portions 48 are each formed into a smooth curve. The bent back portions 48 are bent in an expanding direction in which the bent back portions 48 move away from each other, so that the plate spring 40 can easily be mounted on the seal member 20.

Figure 3:
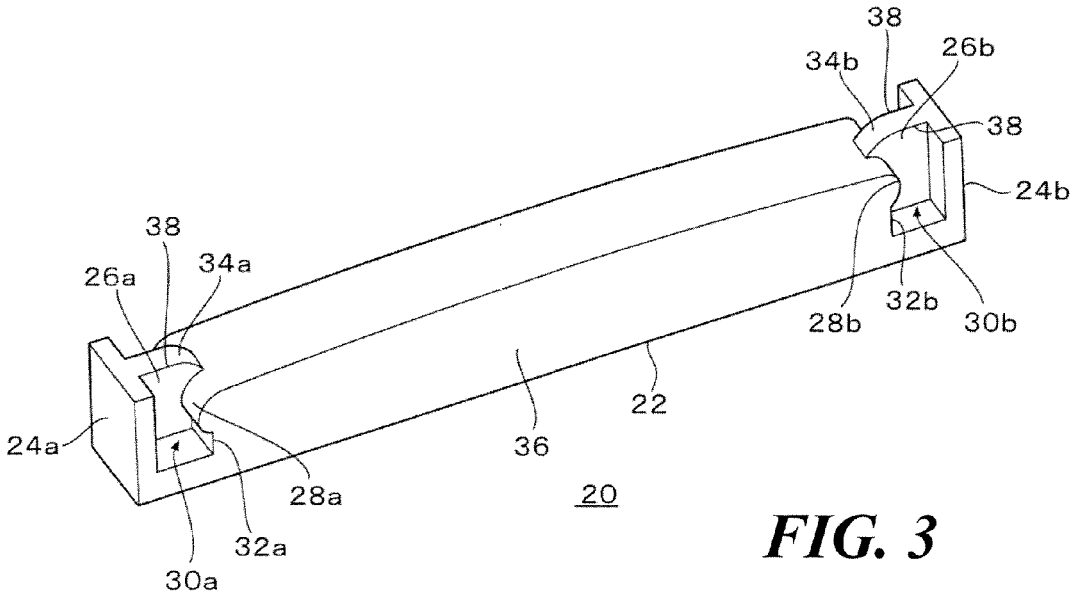
FIG. 3 illustrates a seal member according to the embodiment.
Figure 4:
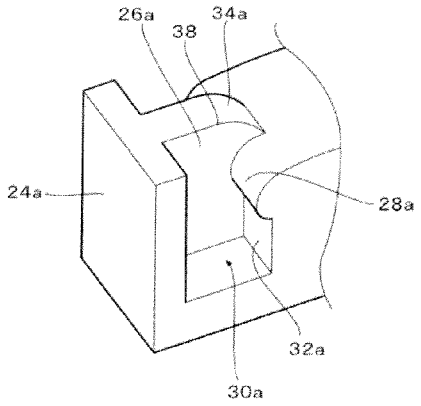
FIG. 4 enlargedly illustrates a part of the seal member.

FIG. 3 illustrates the seal member 20 according to the embodiment. FIG. 4 enlargedly illustrates a part of the seal member 20. The seal member 20 is formed of a resin material and has a seal surface 22, a first erected portion 32*a* and a second erected portion 32*b* (they may be collectively referred to as "erected portions 32", or as "a erected portion 32") which are erected on an opposite side of the seal surface 22 and a first projecting portion 28*a* and a second projecting portion 28*b* (they may be collectively referred to as "projecting portions 28") formed to catch the hook portions 46 of the plate spring 40. "Catching the hook portions 46" denotes a state in which the hook portions 46 are hooked on the projecting portions 28. In this state, when an external force is applied to the seal member 20 from the direction of the plate spring 40, the ends of the plate spring 40 are expanded longitudinally, whereby the hooking of the hook portions 46 on the projecting portions 28 may be temporarily released. However, when the external force is released, the ends of the plate spring 40 return to their original positions, and the hooking of the hook portions 46 is restored.

The projecting portions 28 project in a longitudinal direction of the seal member 20 from longitudinal end faces of the erected portions 32, and have an arc-shaped surface. The seal member 20 also has a first wall portion 24*a* and a second wall portion 24*b* (they may be collectively referred to as "wall portions 24") which are formed on the opposite side of the seal surface 22 at both ends thereof and a first protruding portion 26*a* and a second protruding portion 26*b* they may be collectively referred to as "protruding portions 26") which protrude from the wall portions 24 so as to be inserted into the slit portions 42. While the seal mechanism 10 receives a force from in a lateral direction thereof, a sideway registration error between the seal member 20 and the plate spring 40 can be prevented by inserting the protruding portions 26 into the slit portions 42, as illustrated in FIG. 1A. No projecting portion is provided on external surfaces of the wall portions 24 and lateral surfaces 36 of the seal member 20, and hence, these surfaces are formed flat.

Each of upper surfaces 38 of the protruding portions 26 opposite to the seal surface 22 is formed into a smooth curved surface. And, corners of the upper surfaces 38 opposite to the wall portions 24 are formed into A first round corner 34*a* and a second round corner 34*b* (they may be collectively referred to as "round corners 34"), respectively.

A first end space 30*a* and a second end space 30*b* (they may be collectively referred to as "end spaces 30") are formed between the wall portions 24 and the erected portions 32. As FIG. 1B illustrates, the ends of the plate spring 40 (the bent back portions 48) are accommodated in the end spaces 30.

Figure 5A:
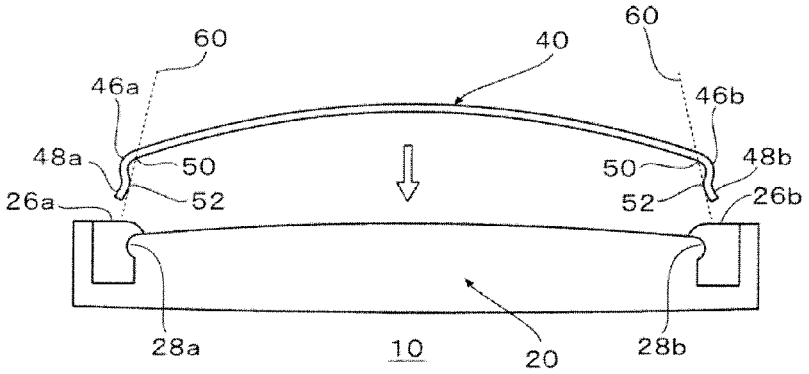
FIGS. 5A to 5C illustrate the mounting of the plate spring into the seal member.
Figure 5B:
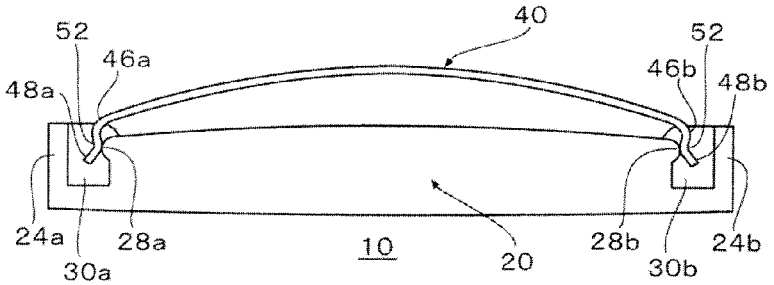
Figure 5C:
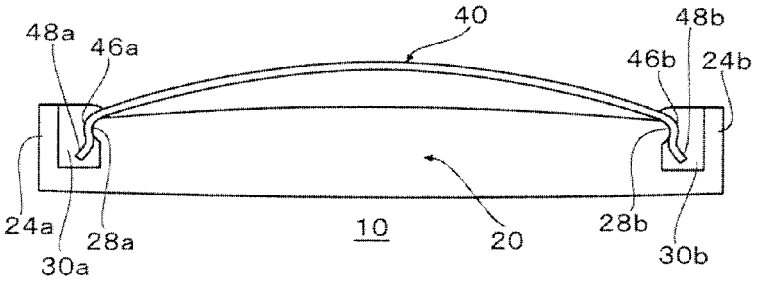

FIGS. 5A to 5C illustrate the mounting of the plate spring 40 into the seal member 20. FIG. 5A illustrates a state before the mounting, FIG. 5B illustrates a state during the mounting, and FIG. 5C illustrates a state after the mounting.

As FIG. 5A illustrates, for the preparation of the mounting, the bent back portions 48 of the plate spring 40 are registered with the projecting portions 28, from a side of the seal member 20 opposite to the seal surface 22. Here, a distance between a distal end of the first bent back portion 48*a* and a distal end of the second bent back portion 48*b* is larger than a distance between a projecting end of the first projecting portion 28*a* and a projecting end of the second projecting portion 28*b*. Further, the bent back portions 48 are expanded. Thus, the mounting of the plate spring 40 on the seal member 20 is facilitated.

A connecting portion between the hook portion 46 and the bent back portion 48 is defined as a constriction portion 52. In FIG. 5A, the dotted lines 60 indicate imaginary lines connecting the bending portions 50 (in this embodiment, the hook portions 46) and the constriction portions 52. As FIG. 5A illustrates, a distance between the constriction portions 52 is formed larger than a distance between the bending portions 50. That is, the hook portions 46 are inclined in an expanding direction as a whole. Thus, the mounting of the plate spring 40 on the seal member 20 can be facilitated.

FIG. 1A illustrates, the slit portions 42 are also registered with the protruding portions 26. Here, the protruding portions 26 project further in a direction perpendicular to the seal surface 22 than the projecting portions 28. During the mounting, firstly, the protruding portions 26 are inserted into the corresponding slit portions 42, whereby the plate spring 40 is positioned with respect to the seal member 20. Thus, the protruding portions 26 function as guides during the mounting. The upper surfaces 38 of the protruding portions 26 are formed into the curved surfaces, whereby the bent back portions 48 are easily fitted on to the protruding portions 26. Further, the round corners 34 are formed on the protruding portions 26, whereby compared with a case where the round corners 34 are not provided but are formed into angular corners, a risk of catching the distal ends of the bent back portions 48 is reduced, whereby the plate spring 40 can smoothly be mounted on the seal member 20.

As FIG. 5B illustrates, while the plate spring 40 is being mounted on the seal member 20, the constriction portions 52 are expanded. The distance between the constriction portions 52 is smaller than the distance between the projecting ends of the projecting portions 28. Thus, when the plate spring 40 is mounted, the constriction portions 52 are expanded by the deflection of the main body portion 44 so that the projecting portions 28 are received in the hook portions 46.

Then, as FIG. 5C illustrates, the projecting portions 28 are received in the hook portions 46, whereby the hook portions 46 are hooked on the projecting portions 28. In this way, the plate spring 40 can easily be mounted on the seal member 20 by deflecting the plate spring 40 so as to expand both the ends thereof. Since both the hook portions 46 and the projecting portions 28 are formed round, the plate spring 40 can smoothly be mounted on the seal member 20.

FIGS. 6A to 6C illustrate the function of the seal mechanism according to the embodiment. FIG. 6A illustrates a state where no force is applied to the plate spring 40, FIG. 6B illustrates a state during an application of a force to the plate spring 40, and FIG. 6C illustrates a state during an application of a force larger than that in the state of FIG. 6B to the plate spring 40. These forces are applied in the direction in which the seal surface 22 contacts a corresponding wall surface.

As FIG. 6A illustrates, both the ends of the plate spring 40 (the hook portions 46 and the bent back portions 48) are accommodated in the end spaces 30 with sufficient margin. In FIGS. 6A and 6C, when the force is applied to the plate spring 40, both the ends of the plate spring 40 are expanded. On this occasion, the ends of the plate spring 40 are prevented from contacting the wall portions 24. That is, the ends of the spring plate 40 are kept free even during the operation. By keeping the ends of the plate spring 40 to be free, the properties of a urging force generated by the plate spring 40 can be made linear. Since the hook portions 46 and the projecting portions 28 are formed round, even when the contact points between the plate spring 40 and the seal member 20 are shifted due to the external force applied to the plate spring 40, the plate spring 40 and the seal member 20 are kept in the smooth contact state, whereby the spring properties of the plate spring 40 are prevented from being changed largely.

In the valve timing adjusting system, a small gap exists between the vane and the housing to facilitate the assemblage of the vane into the housing. Thus, the position of the vane may slightly offset with respect to a rotating axis when the vane rotates relative to the housing. For example, it is preferable that the seal mechanism 10 may be provided in plurality along the circumferential direction between the vane and the housing to have the same spring properties, so that the spring plates 40 operate so as to return the vane from the offset position with respect to the rotating axis. It is further preferable that the plate spring 40 generates the urging force linearly with respect to the displacement (the positional offset of the vane). In the seal mechanism 10 according to the embodiment, the spring properties of the seal mechanism 10 can be stabilized by making both the ends of the plate spring 40 free.

FIG. 7 is a top plan view of a modified example of a plate spring 40 according to the embodiment. In the plate spring 40 of the modified example, a first recessed portion 54*a* and a second recessed portion 54*b* (they may be collectively referred to as "recessed portions 54") are formed. The width of a main body portion 44 is narrowed at these recessed portions 54. Since the width of the main body portion 44 is narrowed at these recessed portions 54, the main body portion 44 deflects largely. By providing the recessed portions 54, variation in load property of the plate spring 40 can be made small relative to variation in dimension of the plate spring 40 in production.

The recessed portions 54 are provided in the vicinity of the slit portions 42 so as to be closer to a central portion of the main body portion 44 than slit portions 42.

The present invention is not limited to the embodiment and the modified example thereof, and hence, modifications including various design changes can be made to the embodiment and the modified example by the skilled person in the art. Embodiments including such modifications will fall within the scope of the present invention.

In the embodiment, while the projecting portions 28 which are round or have the arc shape, any shape can be adopted for the projecting portions 28, as long as the constriction portions 52 at the ends of the plate spring 40 can be hooked thereon, and for example, a conical or pyramidal shape may be adopted.

The invention claimed is:

1. A seal mechanism, comprising:

a plate spring comprising:

a main body portion which has a curved shape; and a pair of hook portions which are formed by bending the main body portion; and a seal member comprising:

a seal surface; and a pair of projecting portions which are formed on an opposite side of the seal surface to catch the hook portions, wherein the plate spring has slit portions formed to bifurcate the ends thereof, wherein the seal member comprises:

wall portions which are formed on the opposite side of the seal surface at both ends thereof, and a pair of protruding portions which protrude from the wall portions so that the slit portions are fitted thereto, respectively, wherein the protruding portions protrude further in a direction perpendicular to the seal surface than the projecting portions, and wherein the slit portions bifurcate the hook portions and the main body portion.

2. The seal mechanism of claim 1, wherein the protruding portions of the seal member are each formed into an arc shape, and wherein the main body portion of the plate spring is configured to contact the opposite side of the seal surface upon application of a force onto the plate spring.

3. The seal mechanism of claim 1, wherein the seal member has wall portions which are formed on the opposite side of the seal surface, wherein the protruding portions of the seal member are positioned between the wall portions, and wherein both ends of the plate spring are adjusted not to contact the respective wall portions even upon application of a force onto the plate spring.

4. A seal mechanism, comprising:

a plate spring having:

a main body portion which has a curved shape; and a pair of hook portions which are formed by bending the main body portion; and a seal member having:

a seal surface; and a pair of projecting portions which are formed on an opposite side of the seal surface to catch the hook portions, wherein the seal member includes:

a pair of wall portions formed on an opposite side of the seal surface at both ends thereof, and an erected portion erected on the opposite side of the seal surface between the wall portions so that both end faces of the erected portion face the wall portions with a gap in a longitudinal direction of the seal member, and wherein the projecting portions project from the both end faces of the erected portion in the longitudinal direction of the seal member toward the wall portions.

5. The seal mechanism of claim 4, wherein the hook portions are each formed into an arc-like shape, and wherein surfaces of the projecting portions are each formed into an arc-like shape so as to match the arc-like shape of the hook portion.

6. The seal mechanism of claim 4, wherein both ends of the plate spring comprise free ends.

7. The seal mechanism of claim 4, wherein the seal member has an erected portion which is erected on the opposite side of the seal surface, and wherein the projecting portions project from end faces of the erected portion.

8. The seal mechanism of claim 4, wherein bent back portions are formed at the ends of the plate spring so as to be bent back from the hook portions.

9. The seal mechanism of claim 8, wherein the bent back portions are bent in an expanding direction in which the bent back portions move away from each other.

10. The seal mechanism of claim 4, wherein the plate spring has slit portions formed to bifurcate the ends thereof, wherein the seal member has:

wall portions which are formed on the opposite side of the seal surface at both ends thereof, and a pair of protruding portions which protrude from the wall portions so that the slit portions are fitted thereto, respectively, and wherein the protruding portions protrude further in a direction perpendicular to the seal surface than the projecting portions.

11. The seal mechanism of claim 10, wherein the plate spring further includes recessed portions which are provided in a vicinity of the slit portions so as to be nearer to a central portion of the main body portion than the slit portions.

12. The seal mechanism of claim 10, wherein upper surfaces of the protruding portions which protrude from the wall portions have a curved surface.

13. The seal mechanism of claim 4, wherein the projecting portions each project from an inner portion of the seal member towards the nearest perimeter of the seal member, respectively.

14. The seal mechanism of claim 4, wherein the seal member comprises a resin material, and wherein the plate spring comprises a metallic material.

15. The seal mechanism of claim 4, wherein the plate spring is elastically deformable.

16. The seal mechanism of claim 4, wherein the projecting portions project in a longitudinal direction of the seal member.

17. The seal mechanism of claim 4, wherein the seal member comprises flat surfaces on external surfaces of the seal member.

* * * * *